US009066176B2

(12) United States Patent
Hendrix et al.

(10) Patent No.: US 9,066,176 B2
(45) Date of Patent: Jun. 23, 2015

(54) SYSTEMS AND METHODS FOR ADAPTIVE NOISE CANCELLATION INCLUDING DYNAMIC BIAS OF COEFFICIENTS OF AN ADAPTIVE NOISE CANCELLATION SYSTEM

(71) Applicant: Cirrus Logic, Inc., Austin, TX (US)

(72) Inventors: Jon D. Hendrix, Wimberley, TX (US); Ning Li, Cedar Park, TX (US); Jeffrey D. Alderson, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 224 days.

(21) Appl. No.: 13/950,854

(22) Filed: Jul. 25, 2013

(65) Prior Publication Data

US 2014/0307899 A1 Oct. 16, 2014

Related U.S. Application Data

(60) Provisional application No. 61/811,915, filed on Apr. 15, 2013.

(51) Int. Cl.
*H04R 5/033* (2006.01)
*G10K 11/178* (2006.01)
*H04R 1/10* (2006.01)

(52) U.S. Cl.
CPC ..... *H04R 5/033* (2013.01); *G10K 11/1784* (2013.01); *H04R 1/1083* (2013.01); *G10K 2210/1081* (2013.01); *H04R 2410/05* (2013.01); *G10K 2210/3026* (2013.01); *G10K 2210/3028* (2013.01)

(58) Field of Classification Search
None
See application file for complete search history.

(56) References Cited

U.S. PATENT DOCUMENTS 5,251,263 A 10/1993 Andrea et al.
5,278,913 A 1/1994 Delfosse et al.
5,337,365 A 8/1994 Hamabe et al.
5,410,605 A 4/1995 Sawada et al.
5,425,105 A 6/1995 Lo et al.

(Continued)

FOREIGN PATENT DOCUMENTS

DE 102011013343 A1 9/2012
EP 0412902 A2 2/1991

(Continued)

OTHER PUBLICATIONS

Kuo, Sen and Tsai, Jianming, Residual noise shaping technique for active noise control systems, J. Acoust. Soc. Am. 95 (3), Mar. 1994, pp. 1665-1668.

(Continued)

*Primary Examiner* — Paul Huber
(74) *Attorney, Agent, or Firm* — Jackson Walker L.L.P.

(57) ABSTRACT

In accordance with method and systems of the present disclosure, a processing circuit may implement an adaptive filter having a response that generates the anti-noise signal from the reference microphone signal to reduce the presence of the ambient audio sounds heard by the listener, a coefficient control block that shapes the response of the adaptive filter in conformity with the error microphone signal and the reference microphone signal by adapting the response of the adaptive filter to minimize the ambient audio sounds in the error microphone signal, and a coefficient bias control block which biases coefficients of the coefficient control block towards zero in a range of frequencies outside of a frequency response of the source audio signal.

39 Claims, 4 Drawing Sheets

(56) References Cited

U.S. PATENT DOCUMENTS

| | | | |
|---|---|---|---|
| 5,481,615 | A | 1/1996 | Eatwell et al. |
| 5,586,190 | A | 12/1996 | Trantow et al. |
| 5,640,450 | A | 6/1997 | Watanabe |
| 5,699,437 | A | 12/1997 | Finn |
| 5,706,344 | A | 1/1998 | Finn |
| 5,768,124 | A | 6/1998 | Stothers et al. |
| 5,815,582 | A | 9/1998 | Claybaugh et al. |
| 5,909,498 | A | 6/1999 | Smith |
| 5,940,519 | A | 8/1999 | Kuo |
| 5,946,391 | A | 8/1999 | Dragwidge et al. |
| 5,991,418 | A | 11/1999 | Kuo |
| 6,041,126 | A | 3/2000 | Terai et al. |
| 6,118,878 | A | 9/2000 | Jones |
| 6,219,427 | B1 | 4/2001 | Kates et al. |
| 6,418,228 | B1 | 7/2002 | Terai et al. |
| 6,434,246 | B1 | 8/2002 | Kates et al. |
| 6,434,247 | B1 | 8/2002 | Kates et al. |
| 6,766,292 | B1 | 7/2004 | Chandran et al. |
| 6,768,795 | B2 | 7/2004 | Feltstrom et al. |
| 6,850,617 | B1 | 2/2005 | Weigand |
| 7,103,188 | B1 | 9/2006 | Jones |
| 7,181,030 | B2 | 2/2007 | Rasmussen et al. |
| 7,330,739 | B2 | 2/2008 | Somayajula |
| 7,365,669 | B1 | 4/2008 | Melanson |
| 7,466,838 | B1 | 12/2008 | Moseley |
| 7,742,790 | B2 | 6/2010 | Konchitsky et al. |
| 8,019,050 | B2 | 9/2011 | Mactavish et al. |
| 8,249,262 | B2 | 8/2012 | Chua et al. |
| 8,290,537 | B2 | 10/2012 | Lee et al. |
| 8,379,884 | B2 | 2/2013 | Horibe et al. |
| 8,401,200 | B2 | 3/2013 | Tiscareno et al. |
| 2001/0053228 | A1 | 12/2001 | Jones |
| 2002/0003887 | A1 | 1/2002 | Zhang et al. |
| 2004/0165736 | A1 | 8/2004 | Hetherington et al. |
| 2004/0167777 | A1 | 8/2004 | Hetherington et al. |
| 2004/0264706 | A1 | 12/2004 | Ray et al. |
| 2005/0117754 | A1 | 6/2005 | Sakawaki |
| 2005/0240401 | A1 | 10/2005 | Ebenezer |
| 2006/0153400 | A1 | 7/2006 | Fujita et al. |
| 2007/0030989 | A1 | 2/2007 | Kates |
| 2007/0033029 | A1 | 2/2007 | Sakawaki |
| 2007/0038447 | A1 | 2/2007 | Kaneko |
| 2007/0053524 | A1 | 3/2007 | Haulick et al. |
| 2007/0076896 | A1 | 4/2007 | Hosaka et al. |
| 2007/0154031 | A1 | 7/2007 | Avendano et al. |
| 2007/0258597 | A1 | 11/2007 | Rasmussen et al. |
| 2007/0297620 | A1 | 12/2007 | Choy |
| 2008/0019548 | A1 | 1/2008 | Avendano |
| 2008/0181422 | A1 | 7/2008 | Christoph |
| 2008/0226098 | A1 | 9/2008 | Haulick et al. |
| 2009/0012783 | A1 | 1/2009 | Klein |
| 2009/0034748 | A1 | 2/2009 | Sibbald |
| 2009/0041260 | A1 | 2/2009 | Jorgensen et al. |
| 2009/0046867 | A1 | 2/2009 | Clemow |
| 2009/0080670 | A1 | 3/2009 | Solbeck et al. |
| 2009/0196429 | A1 | 8/2009 | Ramakrishnan et al. |
| 2009/0220107 | A1 | 9/2009 | Every et al. |
| 2009/0238369 | A1 | 9/2009 | Ramakrishnan et al. |
| 2009/0245529 | A1 | 10/2009 | Asada et al. |
| 2009/0254340 | A1 | 10/2009 | Sun et al. |
| 2009/0290718 | A1 | 11/2009 | Kahn et al. |
| 2009/0296965 | A1 | 12/2009 | Kojima |
| 2009/0304200 | A1 | 12/2009 | Kim et al. |
| 2010/0014683 | A1 | 1/2010 | Maeda et al. |
| 2010/0014685 | A1 | 1/2010 | Wurm |
| 2010/0061564 | A1 | 3/2010 | Clemow et al. |
| 2010/0069114 | A1 | 3/2010 | Lee et al. |
| 2010/0082339 | A1 | 4/2010 | Konchitsky et al. |
| 2010/0098263 | A1 | 4/2010 | Pan et al. |
| 2010/0124336 | A1 | 5/2010 | Shridhar et al. |
| 2010/0166203 | A1 | 7/2010 | Peissig et al. |
| 2010/0195838 | A1 | 8/2010 | Bright |
| 2010/0195844 | A1 | 8/2010 | Christoph et al. |
| 2010/0272276 | A1 | 10/2010 | Carreras et al. |
| 2010/0272283 | A1 | 10/2010 | Carreras et al. |
| 2010/0274564 | A1 | 10/2010 | Bakalos et al. |
| 2010/0296666 | A1 | 11/2010 | Lin |
| 2010/0296668 | A1 | 11/2010 | Lee et al. |
| 2010/0310086 | A1 | 12/2010 | Magrath et al. |
| 2010/0316225 | A1 | 12/2010 | Saito et al. |
| 2010/0322430 | A1 | 12/2010 | Isberg |
| 2011/0007907 | A1 | 1/2011 | Park et al. |
| 2011/0106533 | A1 | 5/2011 | Yu |
| 2011/0142247 | A1 | 6/2011 | Fellers et al. |
| 2011/0144984 | A1 | 6/2011 | Konchitsky |
| 2011/0158419 | A1 | 6/2011 | Theverapperuma et al. |
| 2011/0222698 | A1 | 9/2011 | Asao et al. |
| 2011/0249826 | A1 | 10/2011 | Van Leest |
| 2011/0288860 | A1 | 11/2011 | Schevciw et al. |
| 2011/0293103 | A1 | 12/2011 | Park et al. |
| 2011/0299695 | A1 | 12/2011 | Nicholson |
| 2011/0317848 | A1 | 12/2011 | Ivanov et al. |
| 2012/0135787 | A1 | 5/2012 | Kusunoki et al. |
| 2012/0140943 | A1 | 6/2012 | Hendrix et al. |
| 2012/0170766 | A1 | 7/2012 | Alves et al. |
| 2012/0207317 | A1 | 8/2012 | Abdollahzadeh Milani et al. |
| 2012/0250873 | A1 | 10/2012 | Bakalos et al. |
| 2012/0259626 | A1 | 10/2012 | Li et al. |
| 2012/0263317 | A1 | 10/2012 | Shin et al. |
| 2012/0300958 | A1 | 11/2012 | Klemmensen |
| 2012/0308021 | A1 | 12/2012 | Kwatra et al. |
| 2012/0308024 | A1 | 12/2012 | Alderson et al. |
| 2012/0308025 | A1 | 12/2012 | Hendrix et al. |
| 2012/0308026 | A1 | 12/2012 | Kamath et al. |
| 2012/0308027 | A1 | 12/2012 | Kwatra |
| 2012/0308028 | A1 | 12/2012 | Kwatra et al. |
| 2012/0310640 | A1 | 12/2012 | Kwatra et al. |
| 2013/0010982 | A1 | 1/2013 | Elko et al. |
| 2013/0243225 | A1 | 9/2013 | Yokota |
| 2013/0272539 | A1 | 10/2013 | Kim et al. |
| 2013/0287218 | A1 | 10/2013 | Alderson et al. |
| 2013/0287219 | A1 | 10/2013 | Hendrix et al. |
| 2013/0301842 | A1 | 11/2013 | Hendrix et al. |
| 2013/0301846 | A1 | 11/2013 | Alderson et al. |
| 2013/0301847 | A1 | 11/2013 | Alderson et al. |
| 2013/0301848 | A1 | 11/2013 | Zhou et al. |
| 2013/0301849 | A1 | 11/2013 | Alderson |
| 2013/0343556 | A1 | 12/2013 | Bright |
| 2013/0343571 | A1 | 12/2013 | Rayala et al. |
| 2014/0044275 | A1 | 2/2014 | Goldstein et al. |
| 2014/0050332 | A1 | 2/2014 | Nielsen et al. |
| 2014/0086425 | A1 | 3/2014 | Jensen et al. |
| 2014/0177851 | A1 | 6/2014 | Kitazawa et al. |

FOREIGN PATENT DOCUMENTS

| | | | |
|---|---|---|---|
| EP | 1880699 | A2 | 1/2008 |
| EP | 1947642 | A1 | 7/2008 |
| EP | 2133866 | A1 | 12/2009 |
| EP | 2216774 | A1 | 8/2011 |
| EP | 239550 | A1 | 12/2011 |
| EP | 2395501 | A1 | 12/2011 |
| EP | 2551845 | A1 | 1/2013 |
| EP | 2583074 | A1 | 4/2013 |
| GB | 2401744 | A | 11/2004 |
| GB | 2455821 | A | 6/2009 |
| GB | 2455824 | A | 6/2009 |
| GB | 2455828 | A | 6/2009 |
| GB | 2484722 | A | 4/2012 |
| JP | H06186985 | A | 7/1994 |
| WO | 03015074 | A1 | 2/2003 |
| WO | 03015275 | A1 | 2/2003 |
| WO | WO2004009007 | A1 | 1/2004 |
| WO | 2004017303 | A1 | 2/2004 |
| WO | 2006128768 | A1 | 12/2006 |
| WO | 2007007916 | A1 | 1/2007 |
| WO | 2007113487 | A1 | 11/2007 |
| WO | 2010117714 | A1 | 10/2010 |

(56) References Cited

FOREIGN PATENT DOCUMENTS

| | | | |
|---|---|---|---|
| WO | 2012134874 | A1 | 10/2012 |
| WO | 2012166388 | A2 | 12/2012 |

OTHER PUBLICATIONS

Widrow, B. et al., Adaptive Noise Cancelling: Principles and Applications, Proceedings of the IEEE, IEEE, New York, NY, U.S., vol. 63, No. 13, Dec. 1975, pp. 1692-1716.
Morgan, Dennis R. et al., A Delayless Subband Adaptive Filter Architecture, IEEE Transactions on Signal Processing, IEEE Service Center, New York, NY, U.S., vol. 43, No. 8, Aug. 1995, pp. 1819-1829.
International Patent Application No. PCT/US2014/040999, International Search Report and Written Opinion, Oct. 18, 2014, 12 pages.
International Patent Application No. PCT/US2013/049407, International Search Report and Written Opinion, Jun. 18, 2014, 13 pages.
Pfann, et al., "LMS Adaptive Filtering with Delta-Sigma Modulated Input Signals," IEEE Signal Processing Letters, Apr. 1998, pp. 95-97, vol. 5, No. 4, IEEE Press, Piscataway, NJ.
Toochinda, et al., "A Single-Input Two-Output Feedback Formulation for ANC Problems," Proceedings of the 2001 American Control Conference, Jun. 2001, pp. 923-928, vol. 2, Arlington, VA.
Kuo, et al., "Active Noise Control: A Tutorial Review," Proceedings of the IEEE, Jun. 1999, pp. 943-973, vol. 87, No. 6, IEEE Press, Piscataway, NJ.
Johns, et al., "Continuous-Time LMS Adaptive Recursive Filters," IEEE Transactions on Circuits and Systems, Jul. 1991, pp. 769-778, vol. 38, No. 7, IEEE Press, Piscataway, NJ.
Shoval, et al., "Comparison of DC Offset Effects in Four LMS Adaptive Algorithms," IEEE Transactions on Circuits and Systems II: Analog and Digital Processing, Mar. 1995, pp. 176-185, vol. 42, Issue 3, IEEE Press, Piscataway, NJ.
Mali, Dilip, "Comparison of DC Offset Effects on LMS Algorithm and its Derivatives," International Journal of Recent Trends in Engineering, May 2009, pp. 323-328, vol. 1, No. 1, Academy Publisher.
Kates, James M., "Principles of Digital Dynamic Range Compression," Trends in Amplification, Spring 2005, pp. 45-76, vol. 9, No. 2, Sage Publications.
Gao, et al., "Adaptive Linearization of a Loudspeaker," IEEE International Conference on Acoustics, Speech, and Signal Processing, Apr. 14-17, 1991, pp. 3589-3592, Toronto, Ontario, CA.
Silva, et al., "Convex Combination of Adaptive Filters With Different Tracking Capabilities," IEEE International Conference on Acoustics, Speech, and Signal Processing, Apr. 15-20, 2007, pp. III 925-928, vol. 3, Honolulu, HI, USA.
Akhtar, et al., "A Method for Online Secondary Path Modeling in Active Noise Control Systems," IEEE International Symposium on Circuits and Systems, May 23-26, 2005, pp. 264-267, vol. 1, Kobe, Japan.
Davari, et al., "A New Online Secondary Path Modeling Method for Feedforward Active Noise Control Systems," IEEE International Conference on Industrial Technology, Apr. 21-24, 2008, pp. 1-6, Chengdu, China.
Lan, et al., "An Active Noise Control System Using Online Secondary Path Modeling With Reduced Auxiliary Noise," IEEE Signal Processing Letters, Jan. 2002, pp. 16-18, vol. 9, Issue 1, IEEE Press, Piscataway, NJ.
Liu, et al., "Analysis of Online Secondary Path Modeling With Auxiliary Noise Scaled by Residual Noise Signal," IEEE Transactions on Audio, Speech and Language Processing, Nov. 2010, pp. 1978-1993, vol. 18, Issue 8, IEEE Press, Piscataway, NJ.
D. Senderowicz et al., "Low-Voltage Double-Sampled Delta-Sigma Converters," IEEE J. Solid-State Circuits, vol. 37, pp. 1215-1225, Dec. 1997, 13 pages.
P.J. Hurst and K.C. Dyer, "An improved double sampling scheme for switched-capacitor delta-sigma modulators," IEEE Int. Symp. Circuits Systems, May 1992, vol. 3, pp. 1179-1182, 4 pages.
Lopez-Caudana, Edgar Omar, Active Noise Cancellation: The Unwanted Signal and the Hybrid Solution, Adaptive Filtering Applications, Dr. Lino Garcia, ISBN: 978-953-307-306-4, InTech.
Booji, P.S., Berkhoff, A.P., Virtual sensors for local, three dimensional, broadband multiple-channel active noise control and the effects on the quiet zones, Proceedings of ISMA2010 including USD2010, pp. 151-166.
Jin, et al., "A simultaneous equation method-based online secondary path modeling algorithm for active noise control", Journal of Sound and Vibration, Apr. 25, 2007, pp. 455-474, vol. 303, No. 3-5, London, GB.
Erkelens et al., "Tracking of Nonstationary Noise Based on Data-Driven Recursive Noise Power Estimation", IEEE Transactions on Audio Speech, and Language Processing, vol. 16, No. 6, Aug. 2008.
Rao et al., "A Novel Two Stage Single Channle Speech Enhancement Technique", India Conference (INDICON) 2011 Annual IEEE, IEEE, Dec. 15, 2011.
Rangachari et al., "A noise-estimation algorithm for highly non-stationary environments" Speech Communication, Elsevier Science Publishers, vol. 48, No. 2, Feb. 1, 2006.
International Search Report and Written Opinion of the International Searching Authority, International Patent Application No. PCT/US2014/017343, mailed Aug. 8, 2014, 22 pages.
International Search Report and Written Opinion of the International Searching Authority, International Patent Application No. PCT/US2014/018027, mailed Sep. 4, 2014, 14 pages.
International Search Report and Written Opinion of the International Searching Authority, International Patent Application No. PCT/US2014/017374, mailed Sep. 8, 2014, 13 pages.
International Search Report and Written Opinion of the International Searching Authority, International Patent Application No. PCT/US2014/019395, mailed Sep. 9, 2014, 14 pages.
International Search Report and Written Opinion of the International Searching Authority, International Patent Application No. PCT/US2014/019469, mailed Sep. 12, 2014, 13 pages.
Feng, Jinwei et al., "A broadband self-tuning active noise equaliser", Signal Processing, Elsevier Science Publishers B.V. Amsterdam, NL, vol. 62, No. 2, Oct. 1, 1997, pp. 251-256.
Zhang, Ming et al., "A Robust Online Secondary Path Modeling Method with Auxiliary Noise Power Scheduling Strategy and Norm Constraint Manipulation", IEEE Transactions on Speech and Audio Processing, IEEE Service Center, New York, NY, vol. 11, No. 1, Jan. 1, 2003.
Lopez-Gaudana, Edgar et al., "A hybrid active noise cancelling with secondary path modeling", 51st Midwest Symposium on Circuits and Systems, 2008, MWSCAS 2008, Aug. 10, 2008, pp. 277-280.
Milani, et al., "On Maximum Achievable Noise Reduction in ANC Systems", Proceedings of the IEEE International Conference on Acoustics, Speech, and Signal Processing, ICASSP 2010, Mar. 14-19, 2010 pp. 349-352.
Ryan, et al., "Optimum near-field performance of microphone arrays subject to a far-field beampattern constraint", 2248 J. Acoust. Soc. Am. 108, Nov. 2000.
Cohen, et al., "Noise Estimation by Minima Controlled Recursive Averaging for Robust Speech Enhancement", IEEE Signal Processing Letters, vol. 9, No. 1, Jan. 2002.
Martin, "Noise Power Spectral Density Estimation Based on Optimal Smoothing and Minimum Statistics", IEEE Trans. on Speech and Audio Processing, Col. 9, No. 5, Jul. 2001.
Martin, "Spectral Subtraction Based on Minimum Statistics", Proc. 7th EUSIPCO '94, Edinburgh, U.K., Sep. 13-16, 1994, pp. 1182-1195.
Cohen, "Noise Spectrum Estimation in Adverse Environments: Improved Minima Controlled Recursive Averaging", IEEE Trans. on Speech & Audio Proc., vol. 11, Issue 5, Sep. 2003.
Black, John W., "An Application of Side-Tone in Subjective Tests of Microphones and Headsets", Project Report No. NM 001 064.01.20, Research Report of the U.S. Naval School of Aviation Medicine, Feb. 1, 1954, 12 pages. (pp. 1-12 in pdf), Pensacola, FL, US.

(56) References Cited

OTHER PUBLICATIONS

Lane, et al., "Voice Level: Autophonic Scale, Perceived Loudness, and the Effects of Sidetone", The Journal of the Acoustical Society of America, Feb. 1961, pp. 160-167, vol. 33, No. 2., Cambridge, MA, US.
Liu, et al., "Compensatory Responses to Loudness-shifted Voice Feedback During Production of Mandarin Speech", Journal of the Acoustical Society of America, Oct. 2007, pp. 2405-2412, vol. 122, No. 4.
Paepcke, et al., "Yelling in the Hall: Using Sidetone to Address a Problem with Mobile Remote Presence Systems", Symposium on User Interface Software and Technology, Oct. 16-19, 2011, 10 pages (pp. 1-10 in pdf), Santa Barbara, CA, US.
Peters, Robert W., "The Effect of High-Pass and Low-Pass Filtering of Side-Tone Upon Speaker Intelligibility", Project Report No. NM 001 064.01.25, Research Report of the U.S. Naval School of Aviation Medicine, Aug. 16, 1954, 13 pages (pp. 1-13 in pdf), Pensacola, FL, US.
Therrien, et al., "Sensory Attenuation of Self-Produced Feedback: The Lombard Effect Revisited", PLOS One, Nov. 2012, pp. 1-7, vol. 7, Issue 11, e49370, Ontario, Canada.
Campbell, Mikey, "Apple looking into self-adjusting earbud headphones with noise cancellation tech", Apple Insider, Jul. 4, 2013, pp. 1-10 (10 pages in pdf), downloaded on May 14, 2014 from http://appleinsider.com/articles/13/07/04/apple-looking-into-self-adjusting-earbud-headphones-with-noise-cancellation-tech.
International Patent Application No. PCT/US2014/017096, International Search Report and Written Opinion, May 27, 2014, 11 pages.
International Patent Application No. PCT/US2014/049600, International Search Report and Written Opinion, Jan. 14, 2015, 12 pages.
International Patent Application No. PCT/US2014/061753, International Search Report and Written Opinion, Feb. 9, 2015, 8 pages.
International Patent Application No. PCT/US2014/061548, International Search Report and Written Opinion, Feb. 12, 2015, 13 pages.
International Patent Application No. PCT/US2014/060277, International Search Report and Written Opinion, Mar. 9, 2015, 11 pages.

SYSTEMS AND METHODS FOR ADAPTIVE NOISE CANCELLATION INCLUDING DYNAMIC BIAS OF COEFFICIENTS OF AN ADAPTIVE NOISE CANCELLATION SYSTEM

RELATED APPLICATION

The present disclosure claims priority to U.S. Provisional Patent Application Ser. No. 61/811,915, filed Apr. 15, 2013, which is incorporated by reference herein in its entirety.

FIELD OF DISCLOSURE

The present disclosure relates in general to adaptive noise cancellation in connection with an acoustic transducer, and more particularly, to detection and cancellation of ambient noise present in the vicinity of the acoustic transducer by dynamically biasing coefficients of an adaptive noise cancellation system.

BACKGROUND

Wireless telephones, such as mobile/cellular telephones, cordless telephones, and other consumer audio devices, such as mp3 players, are in widespread use. Performance of such devices with respect to intelligibility can be improved by providing noise canceling using a microphone to measure ambient acoustic events and then using signal processing to insert an anti-noise signal into the output of the device to cancel the ambient acoustic events. Because the acoustic environment around personal audio devices such as wireless telephones can change dramatically, depending on the sources of noise that are present and the position of the device itself, it is desirable to adapt the noise canceling to take into account such environmental changes.

Adaptive noise cancellation may be used in many elements of personal audio devices, including headphones. Headphones that provide adaptive noise cancellation to a listener may also be used to play audio content to the headphones in a variety of cases. For example, in a phone call, audio content may occupy a telephone speech band of between 300 Hz and 3.4 kHz, inclusive, or in a high-fidelity audio playback situation, the audio content may occupy a frequency range of 20 Hz to 20 kHz, inclusive, for some audio tracks, or 100 Hz to 8 kHz for some compressed audio content. An adaptive noise cancellation system must be stable under all conditions, regardless of the bandwidth of the ambient noise or the bandwidth of a source audio signal. Any adaptive system that depends on a model of an electro-acoustic path of the source audio signal through a transducer, for example a filtered-X least-mean-square feedforward adaptive system, must comprehend the frequency spectra of the various signals involved in such a way that instability in adaptation is avoided.

SUMMARY

In accordance with the teachings of the present disclosure, the disadvantages and problems associated with detection and reduction of ambient noise associated with an acoustic transducer may be reduced or eliminated. In accordance with embodiments of the present disclosure, a personal audio device may include a transducer, a reference microphone, an error microphone, and a processing circuit. The transducer may reproduce an audio signal including both source audio for playback to a listener and an anti-noise signal for countering the effects of ambient audio sounds in an acoustic output of the transducer. The reference microphone may provide a reference microphone signal indicative of the ambient audio sounds. The error microphone may be located in proximity to the transducer and may provide an error microphone signal indicative of the acoustic output of the transducer and the ambient audio sounds at the transducer. The processing circuit may implement an adaptive filter having a response that generates the anti-noise signal from the reference microphone signal to reduce the presence of the ambient audio sounds heard by the listener, a coefficient control block that shapes the response of the adaptive filter in conformity with the error microphone signal and the reference microphone signal by adapting the response of the adaptive filter to minimize the ambient audio sounds in the error microphone signal, and a coefficient bias control block which biases coefficients of the coefficient control block towards zero in a range of frequencies outside of a frequency response of the source audio signal.

In accordance with these and other embodiments of the present disclosure, a method for canceling ambient audio sounds in the proximity of a transducer of a personal audio device may include receiving a reference microphone signal indicative of the ambient audio sounds. The method may also include receiving an error microphone signal indicative of the output of the transducer and the ambient audio sounds at the transducer. The method may further include adaptively generating an anti-noise signal from a result of the measuring with the reference microphone countering the effects of ambient audio sounds at an acoustic output of the transducer by adapting a response of an adaptive filter that filters an output of the reference microphone to minimize the ambient audio sounds in the error microphone signal. The method may additionally include biasing coefficients for controlling the response of the adaptive filter towards zero in a range of frequencies outside of a frequency response of the source audio signal. In addition, the method may include combining the anti-noise signal with a source audio signal to generate an audio signal provided to the transducer.

In accordance with these and other embodiments of the present disclosure, an integrated circuit for implementing at least a portion of a personal audio device may include an output, a reference microphone input, an error microphone input, and a processing circuit. The output may provide a signal to a transducer including both a source audio signal for playback to a listener and an anti-noise signal for countering the effect of ambient audio sounds in an acoustic output of the transducer. The reference microphone input may receive a reference microphone signal indicative of the ambient audio sounds. The error microphone input may receive an error microphone signal indicative of the output of the transducer and the ambient audio sounds at the transducer. The processing circuit may implement an adaptive filter having a response that generates the anti-noise signal from the reference microphone signal to reduce the presence of the ambient audio sounds heard by the listener, a coefficient control block that shapes the response of the adaptive filter in conformity with the error microphone signal and the reference microphone signal by adapting the response of the adaptive filter to minimize the ambient audio sounds in the error microphone signal, and a coefficient bias control block which biases coefficients of the coefficient control block towards zero in a range of frequencies outside of a frequency response of the source audio signal.

In accordance with these and other embodiments of the present disclosure, a personal audio device may include a transducer, a reference microphone, an error microphone, and a processing circuit. The transducer may reproduce an audio signal including both source audio for playback to a listener and an anti-noise signal for countering the effects of ambient audio sounds in an acoustic output of the transducer. The reference microphone may provide a reference microphone signal indicative of the ambient audio sounds. The error microphone may be located in proximity to the transducer and may provide an error microphone signal indicative of the acoustic output of the transducer and the ambient audio sounds at the transducer. The processing circuit may implement a feedforward filter having a response that generates the anti-noise signal from the reference microphone signal to reduce the presence of the ambient audio sounds heard by the listener, a secondary path estimate adaptive filter configured to model an electro-acoustic path of the source audio signal and have a response that generates a secondary path estimate from the source audio, a coefficient control block that shapes the response of the secondary path estimate adaptive filter in conformity with the source audio signal and a playback corrected error by adapting the response of the secondary path estimate filter to minimize the playback corrected error, wherein the playback corrected error is based on a difference between the error microphone signal and the secondary path estimate, and a coefficient bias control block which biases coefficients of the coefficient control block towards zero in a range of frequencies outside of a frequency response of the source audio signal.

In accordance with these and other embodiments of the present disclosure, a method for canceling ambient audio sounds in the proximity of a transducer of a personal audio device may include receiving a reference microphone signal indicative of the ambient audio sounds. The method may also include receiving an error microphone signal indicative of the output of the transducer and the ambient audio sounds at the transducer. The method may further include generating an anti-noise signal component from a result of the measuring with the reference microphone countering the effects of ambient audio sounds at an acoustic output of the transducer by filtering an output of the reference microphone. The method may additionally include adaptively generating a secondary path estimate from the source audio signal by filtering the source audio signal with a secondary path estimate adaptive filter modeling an electro-acoustic path of the source audio signal and adapting the response of the secondary path estimate adaptive filter to minimize a playback corrected error based on a difference between the error signal and the secondary path estimate. In addition, the method may include biasing coefficients for controlling the response of the secondary path estimate adaptive filter towards zero in a range of frequencies outside of a frequency response of the source audio signal. The method may further include combining the anti-noise signal with a source audio signal to generate an audio signal provided to the transducer.

In accordance with these and other embodiments of the present disclosure, an integrated circuit for implementing at least a portion of a personal audio device may include an output, a reference microphone input, an error microphone input, and a processing circuit. The output may provide a signal to a transducer including both a source audio signal for playback to a listener and an anti-noise signal for countering the effect of ambient audio sounds in an acoustic output of the transducer. The reference microphone input may receive a reference microphone signal indicative of the ambient audio sounds. The error microphone input may receive an error microphone signal indicative of the output of the transducer and the ambient audio sounds at the transducer. The processing circuit may implement a feedforward filter having a response that generates the anti-noise signal from the reference microphone signal to reduce the presence of the ambient audio sounds heard by the listener, a secondary path estimate adaptive filter for modeling an electro-acoustic path of the source audio signal having a response that generates a secondary path estimate from the source audio, a coefficient control block that shapes the response of the secondary path estimate adaptive filter in conformity with the source audio signal and a playback corrected error by adapting the response of the secondary path estimate filter to minimize the playback corrected error, wherein the playback corrected error is based on a difference between the error microphone signal and the secondary path estimate, and a coefficient bias control block which biases coefficients of the coefficient control block towards zero in a range of frequencies outside of a frequency response of the source audio signal.

Technical advantages of the present disclosure may be readily apparent to one of ordinary skill in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

The present disclosure encompasses noise canceling techniques and circuits that can be implemented in a personal audio device, such as a wireless telephone. The personal audio device includes an ANC circuit that may measure the ambient acoustic environment and generate a signal that is injected in the speaker (or other transducer) output to cancel ambient acoustic events. A reference microphone may be provided to measure the ambient acoustic environment and an error microphone may be included for controlling the adaptation of the anti-noise signal to cancel the ambient audio sounds and for correcting for the electro-acoustic path from the output of the processing circuit through the transducer.

Figure 1A:
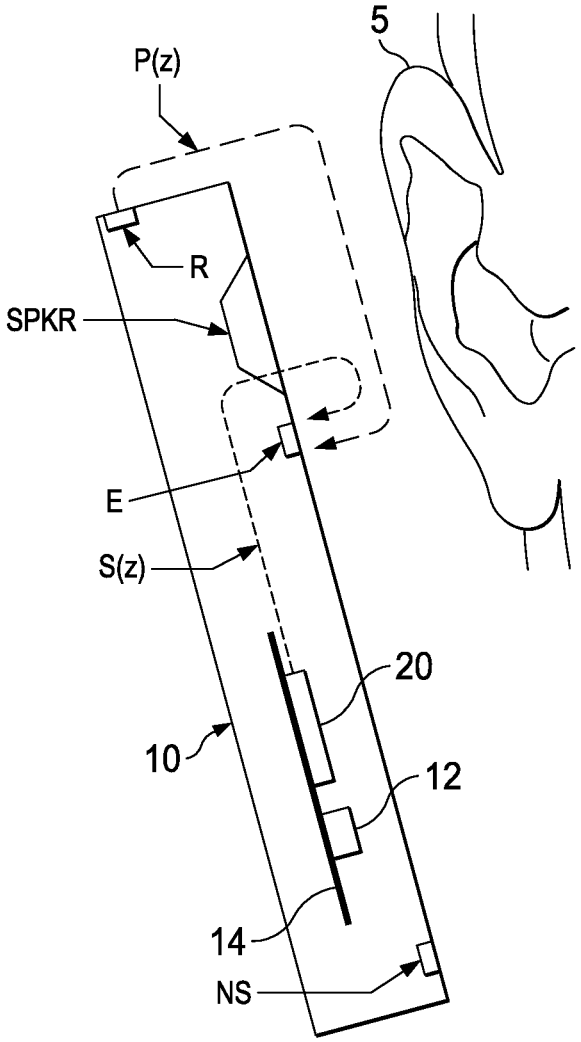
FIG. 1A is an illustration of an example wireless mobile telephone, in accordance with embodiments of the present disclosure.

Referring now to FIG. 1A, a wireless telephone 10 as illustrated in accordance with embodiments of the present disclosure is shown in proximity to a human ear 5. Wireless telephone 10 is an example of a device in which techniques in accordance with embodiments of the present disclosure may be employed, but it is understood that not all of the elements or configurations embodied in illustrated wireless telephone 10, or in the circuits depicted in subsequent illustrations, are required in order to practice the inventions recited in the claims. Wireless telephone 10 may include a transducer such as speaker SPKR that reproduces distant speech received by wireless telephone 10, along with other local audio events such as ringtones, stored audio program material, injection of near-end speech (i.e., the speech of the user of wireless telephone 10) to provide a balanced conversational perception, and other audio that requires reproduction by wireless telephone 10, such as sources from webpages or other network communications received by wireless telephone 10 and audio indications such as a low battery indication and other system event notifications. A near-speech microphone NS may be provided to capture near-end speech, which is transmitted from wireless telephone 10 to the other conversation participant(s).

Wireless telephone 10 may include ANC circuits and features that inject an anti-noise signal into speaker SPKR to improve intelligibility of the distant speech and other audio reproduced by speaker SPKR. A reference microphone R may be provided for measuring the ambient acoustic environment, and may be positioned away from the typical position of a user's mouth, so that the near-end speech may be minimized in the signal produced by reference microphone R. Another microphone, error microphone E, may be provided in order to further improve the ANC operation by providing a measure of the ambient audio combined with the audio reproduced by speaker SPKR close to ear 5, when wireless telephone 10 is in close proximity to ear 5. In these and other embodiments, additional reference microphones and/or error microphones may be employed. Circuit 14 within wireless telephone 10 may include an audio CODEC integrated circuit (IC) 20 that receives the signals from reference microphone R, near-speech microphone NS, and error microphone E and interfaces with other integrated circuits such as a radio-frequency (RF) integrated circuit 12 having a wireless telephone transceiver. In some embodiments of the disclosure, the circuits and techniques disclosed herein may be incorporated in a single integrated circuit that includes control circuits and other functionality for implementing the entirety of the personal audio device, such as an MP3 player-on-a-chip integrated circuit. In some embodiments of the disclosure, the circuits and techniques disclosed herein may be incorporated in a single integrated circuit that includes control circuits and other functionality for implementing the entirety of the personal audio device, such as an MP3 player-on-a-chip integrated circuit. In these and other embodiments, the circuits and techniques disclosed herein may be implemented partially or fully in software and/or firmware embodied in computer-readable media and executable by a controller or other processing device.

In general, ANC techniques of the present disclosure measure ambient acoustic events (as opposed to the output of speaker SPKR and/or the near-end speech) impinging on reference microphone R, and by also measuring the same ambient acoustic events impinging on error microphone E, ANC processing circuits of wireless telephone 10 adapt an anti-noise signal generated from the output of reference microphone R to have a characteristic that minimizes the amplitude of the ambient acoustic events at error microphone E. Because acoustic path P(z) extends from reference microphone R to error microphone E, ANC circuits are effectively estimating acoustic path P(z) while removing effects of an electro-acoustic path S(z) that represents the response of the audio output circuits of CODEC IC 20 and the acoustic/electric transfer function of speaker SPKR including the coupling between speaker SPKR and error microphone E in the particular acoustic environment, which may be affected by the proximity and structure of ear 5 and other physical objects and human head structures that may be in proximity to wireless telephone 10, when wireless telephone 10 is not firmly pressed to ear 5. While the illustrated wireless telephone 10 includes a two-microphone ANC system with a third near-speech microphone NS, some aspects of the present invention may be practiced in a system that does not include separate error and reference microphones, or a wireless telephone that uses near-speech microphone NS to perform the function of the reference microphone R. Also, in personal audio devices designed only for audio playback, near-speech microphone NS will generally not be included, and the near-speech signal paths in the circuits described in further detail below may be omitted, without changing the scope of the disclosure.

Figure 1B:
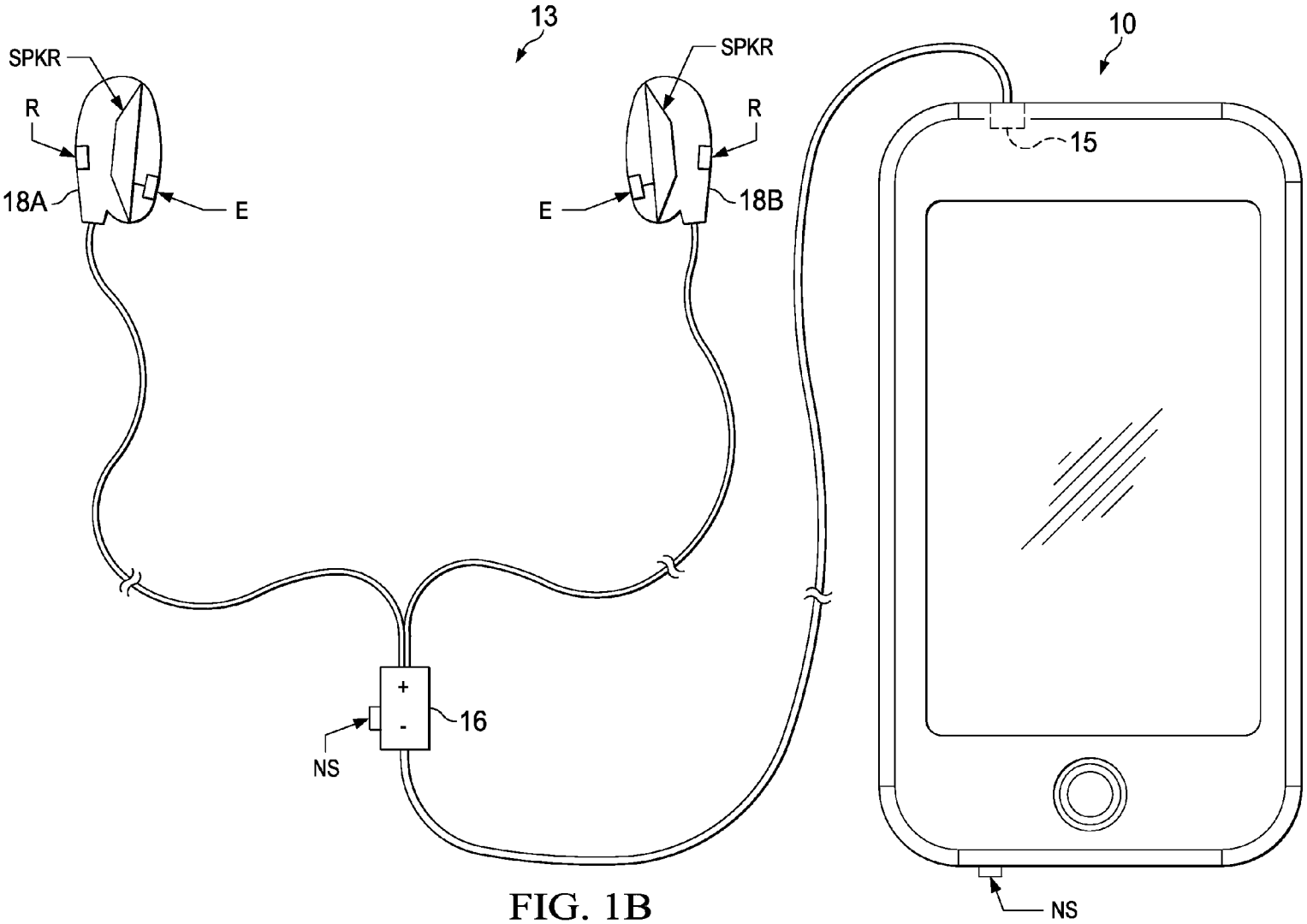
FIG. 1B is an illustration of an example wireless mobile telephone with a headphone assembly coupled thereto, in accordance with embodiments of the present disclosure.

Referring now to FIG. 1B, wireless telephone 10 is depicted having a headphone assembly 13 coupled to it via audio port 15. Audio port 15 may be communicatively coupled to RF integrated circuit 12 and/or CODEC IC 20, thus permitting communication between components of headphone assembly 13 and one or more of RF integrated circuit 12 and/or CODEC IC 20. As shown in FIG. 1B, headphone assembly 13 may include a combox 16, a left headphone 18A, and a right headphone 18B. As used in this disclosure, the term "headphone" broadly includes any loudspeaker and structure associated therewith that is intended to be mechanically held in place proximate to a listener's ear or ear canal, and includes without limitation earphones, earbuds, and other similar devices. As more specific non-limiting examples, "headphone," may refer to intra-canal earphones, intra-concha earphones, supra-concha earphones, and supra-aural earphones.

Combox 16 or another portion of headphone assembly 13 may have a near-speech microphone NS to capture near-end speech in addition to or in lieu of near-speech microphone NS of wireless telephone 10. In addition, each headphone 18A, 18B may include a transducer such as speaker SPKR that reproduces distant speech received by wireless telephone 10, along with other local audio events such as ringtones, stored audio program material, injection of near-end speech (i.e., the speech of the user of wireless telephone 10) to provide a balanced conversational perception, and other audio that requires reproduction by wireless telephone 10, such as sources from webpages or other network communications received by wireless telephone 10 and audio indications such as a low battery indication and other system event notifications. Each headphone 18A, 18B may include a reference microphone R for measuring the ambient acoustic environment and an error microphone E for measuring of the ambient audio combined with the audio reproduced by speaker SPKR close a listener's ear when such headphone 18A, 18B is engaged with the listener's ear. In some embodiments, CODEC IC 20 may receive the signals from reference microphone R, near-speech microphone NS, and error microphone E of each headphone and perform adaptive noise cancellation for each headphone as described herein. In other embodiments, a CODEC IC or another circuit may be present within headphone assembly 13, communicatively coupled to reference microphone R, near-speech microphone NS, and error microphone E, and configured to perform adaptive noise cancellation as described herein.

Figure 2:
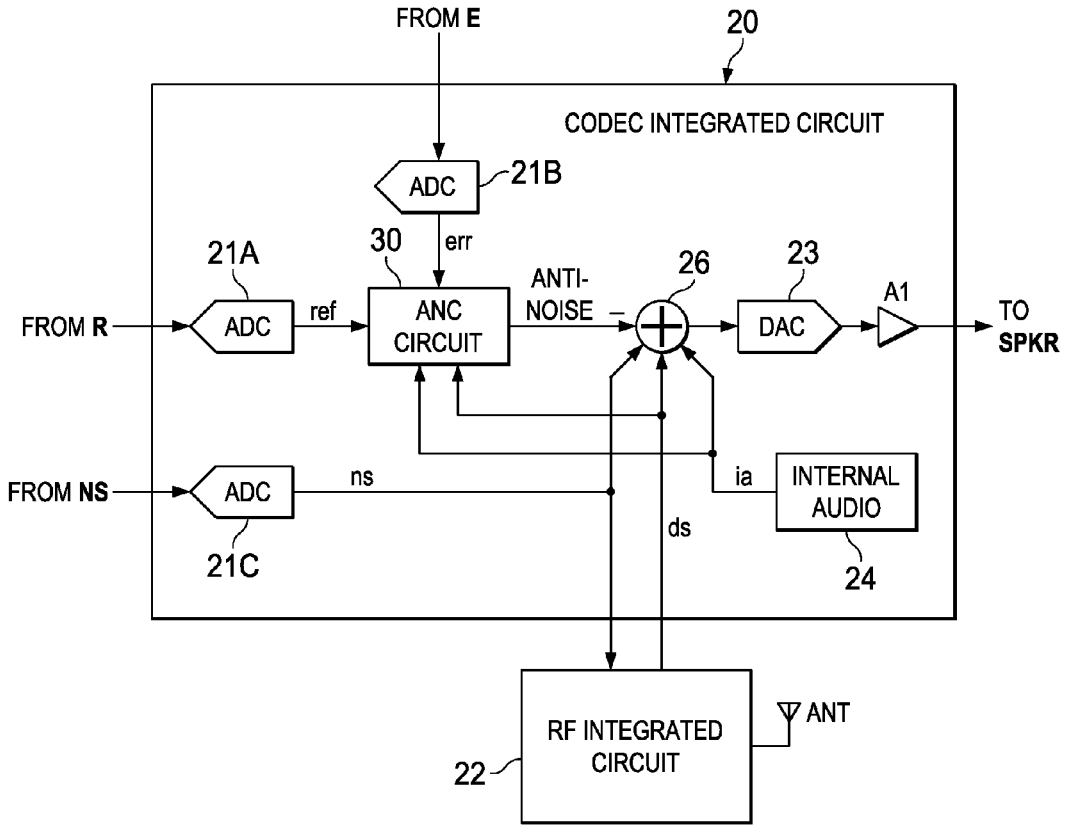
FIG. 2 is a block diagram of selected circuits within the wireless telephone depicted in FIG. 1, in accordance with embodiments of the present disclosure.

Referring now to FIG. 2, selected circuits within wireless telephone 10, which in other embodiments may be placed in whole or part in other locations such as one or more headphone assemblies 13, are shown in a block diagram. CODEC IC 20 may include an analog-to-digital converter (ADC) 21A for receiving the reference microphone signal and generating a digital representation ref of the reference microphone signal, an ADC 21B for receiving the error microphone signal and generating a digital representation err of the error microphone signal, and an ADC 21C for receiving the near speech microphone signal and generating a digital representation ns of the near speech microphone signal. CODEC IC 20 may generate an output for driving speaker SPKR from an amplifier Al, which may amplify the output of a digital-to-analog converter (DAC) 23 that receives the output of a combiner 26. Combiner 26 may combine audio signals is from internal audio sources 24, the anti-noise signal generated by ANC circuit 30, which by convention has the same polarity as the noise in reference microphone signal ref and is therefore subtracted by combiner 26, and a portion of near speech microphone signal ns so that the user of wireless telephone 10 may hear his or her own voice in proper relation to downlink speech ds, which may be received from radio frequency (RF) integrated circuit 22 and may also be combined by combiner 26. Near speech microphone signal ns may also be provided to RF integrated circuit 22 and may be transmitted as uplink speech to the service provider via antenna ANT.

Figure 3:
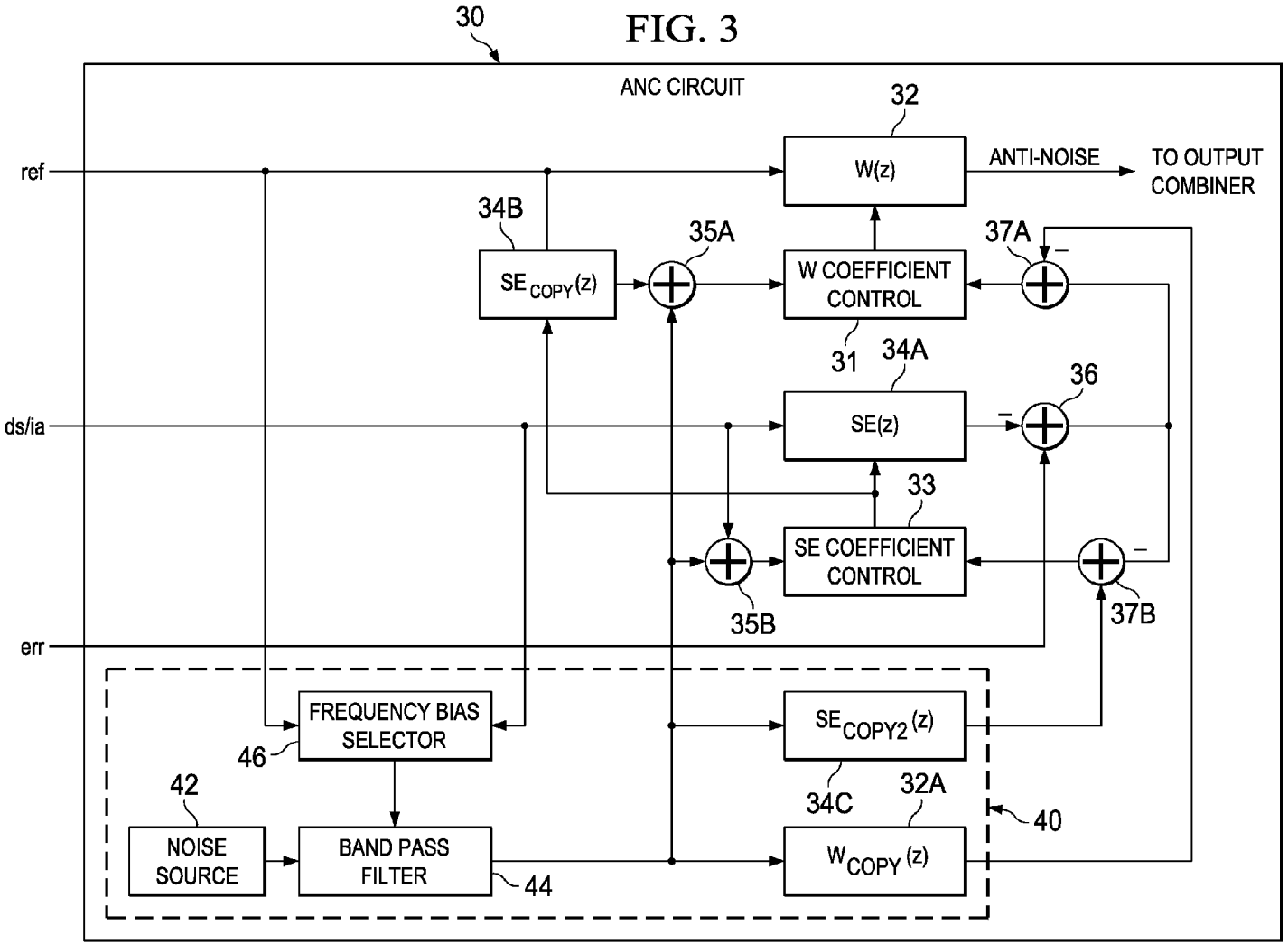
FIG. 3 is a block diagram depicting selected signal processing circuits and functional blocks within an example adaptive noise canceling (ANC) circuit of a coder-decoder (CODEC) integrated circuit of FIG. 2, in accordance with embodiments of the present disclosure.

Referring now to FIG. 3, details of ANC circuit 30 are shown in accordance with embodiments of the present disclosure. Adaptive filter 32 may receive reference microphone signal ref and under ideal circumstances, may adapt its transfer function W(z) to be P(z)/S(z) to generate the anti-noise signal, which may be provided to an output combiner that combines the anti-noise signal with the audio to be reproduced by the transducer, as exemplified by combiner 26 of FIG. 2. The coefficients of adaptive filter 32 may be controlled by a W coefficient control block 31 that uses a correlation of signals to determine the response of adaptive filter 32, which generally minimizes the error, in a least-mean-squares sense, between those components of reference microphone signal ref present in error microphone signal err. The signals compared by W coefficient control block 31 may be the reference microphone signal ref as shaped by a copy of an estimate of the response of path S(z) provided by filter 34B (as modified by a noise-injection signal by combiner 35A as described in greater detail below) and another signal that includes error microphone signal err (as modified by a noise-injection signal by combiner 37A as described in greater detail below). By transforming reference microphone signal ref with a copy of the estimate of the response of path S(z), response $SE_{copy}(z)$, and minimizing the difference between the resultant signal and error microphone signal err, adaptive filter 32 may adapt to the desired response of P(z)/S(z). In addition to error microphone signal err, the signal compared to the output of filter 34B by W coefficient control block 31 may include an inverted amount of downlink audio signal ds and/or internal audio signal ia that has been processed by filter response SE(z), of which response $SE_{copy}(z)$ is a copy. By injecting an inverted amount of downlink audio signal ds and/or internal audio signal ia, adaptive filter 32 may be prevented from adapting to the relatively large amount of downlink audio and/or internal audio signal present in error microphone signal err and by transforming that inverted copy of downlink audio signal ds and/or internal audio signal ia with the estimate of the response of path S(z), the downlink audio and/or internal audio that is removed from error microphone signal err should match the expected version of downlink audio signal ds and/or internal audio signal ia reproduced at error microphone signal err, because the electrical and acoustical path of S(z) is the path taken by downlink audio signal ds and/or internal audio signal ia to arrive at error microphone E. Filter 34B may not be an adaptive filter, per se, but may have an adjustable response that is tuned to match the response of adaptive filter 34A, so that the response of filter 34B tracks the adapting of adaptive filter 34A.

To implement the above, adaptive filter 34A may have coefficients controlled by SE coefficient control block 33, which may compare downlink audio signal ds and/or internal audio signal ia (as modified by a noise-injection signal by combiner 35B as described in greater detail below) with a playback corrected error equal to error microphone signal err after removal of the above-described filtered downlink audio signal ds and/or internal audio signal ia that has been filtered by adaptive filter 34A to represent the expected downlink audio delivered to error microphone E, and which is removed from the output of adaptive filter 34A by a combiner 36 (and which may be modified by a noise-injection signal by combiner 37B as described in greater detail below). SE coefficient control block 33 may correlate the actual downlink speech signal ds and/or internal audio signal ia with the components of downlink audio signal ds and/or internal audio signal ia that are present in error microphone signal err. Adaptive filter 34A may thereby be adapted to generate a signal from downlink audio signal ds and/or internal audio signal ia, that when subtracted from error microphone signal err, contains the content of error microphone signal err that is not due to downlink audio signal ds and/or internal audio signal ia.

As depicted in FIG. 3, ANC circuit 30 may include a coefficient bias control block 40 which biases coefficients of one or more of W coefficient control block 31 and SE coefficient control block 33 towards zero in one or more particular ranges of frequencies, as described in further detail below. In some embodiments, coefficient bias control block 40 may have structure and/or functionality identical or similar to that disclosed in U.S. patent application Ser. No. 13/333,484 entitled "Methods for Bandlimiting Antinoise in Earpiece Active Noise Cancel Headset," and filed on Dec. 21, 2011, which is incorporated herein by reference thereto. For purposes of clarity and exposition of the present disclosure, the level of detail disclosed in U.S. patent application Ser. No. 13/333,484 regarding certain functionality of coefficient bias control block 40 is not repeated herein, but rather is summarized to describe implementation details pertinent to the present disclosure.

As shown in FIG. 3, coefficient bias control block 40 may include a noise source 42, a bandpass filter 44, a frequency bias selector 46, a filter 32A configured to apply a response which is a copy of the response of adaptive filter 32, and a filter 34C configured to apply a response which is a copy of the response of adaptive filter 34A. In operation, noise source 42 may generate white noise (e.g., an audio signal with a constant amplitude across all frequencies of interest, such as those frequencies within the range of human hearing) which is filtered by band pass filter 44 to generate an injected noise signal. The bandpass range of frequencies of the white noise passed by bandpass filter 44 to generate the injected noise signal may be controlled by frequency bias selector 46, which may select an upper bound and lower bound of the bandpass range based on reference signal ref, a source audio signal (e.g., downlink speech signal ds and/or internal audio signal ia), and/or frequency limits of a transducer (e.g., speaker SPKR) for playing back the source audio signal, as described in greater detail below. In some embodiments, the injected noise signal may be combined (e.g., by combiner 35A) with reference microphone signal ref as filtered by filter 34B and communicated to W coefficient control block 31. In these and other embodiments, the injected noise signal may be combined (e.g., by combiner 35B) with a source audio signal (downlink speech signal ds and/or internal audio signal ia) and communicated to SE coefficient control block 33.

In addition, filter 32A may filter the injected noise signal with the response $W_{COPY}(z)$, which is a copy of the response W(z) of adaptive filter 32, to generate a W-filtered noise injection signal. Filter 32A may not be an adaptive filter, per se, but may have an adjustable response that is tuned to match the response of adaptive filter 32, so that the response of filter 32A tracks the adapting of adaptive filter 32. In some embodiments, the W-filtered noise injection signal and the injected noise signal may be combined (e.g., by combiner 37A) with the playback corrected error signal and communicated to W coefficient control block 31.

In these and other embodiments, filter 34C may filter the injected noise signal with the response $S_{COPY2}(z)$, which is a copy of the response SE(z) of adaptive filter 34A, to generate a SE-filtered noise injection signal. Filter 34C may not be an adaptive filter, per se, but may have an adjustable response that is tuned to match the response of adaptive filter 34A, so that the response of filter 34C tracks the adapting of adaptive filter 34A. In some embodiments, the SE-filtered noise injection signal and the injected noise signal may be combined (e.g., by combiner 37B) with the playback corrected error signal and communicated to SE coefficient control block 33.

As mentioned above, frequency bias selector 46 may select an upper bound and lower bound of the bandpass range of bandpass filter 44 based on reference signal ref, a source audio signal (e.g., downlink speech signal ds and/or internal audio signal ia), and/or frequency limits of a transducer (e.g., speaker SPKR) for playing back the source audio signal. In some embodiments, frequency bias selector 46 may select a lower bound of the bandpass range equal to an approximate upper bound of the frequency content of the source audio signal. In such embodiments, frequency bias selector 46 may dynamically track frequency content of the source audio signal in order to determine the lower bound of the bandpass range based on a recent trend of the upper bound of frequency content of the source audio signal (e.g., a trailing average of the upper bound of the frequency content). In these and other embodiments, frequency bias selector 46 may select an upper bound and a lower bound for the bandpass range such that the bandpass range is within a frequency response of the transducer for playing back the source audio signal (e.g., speaker SPKR) and within a frequency response of ambient audio sounds as indicated by reference microphone signal ref. In such embodiments, frequency bias selector 46 may select an upper bound for the bandpass range equal to an approximate upper bound of frequency response of the transducer or equal to an approximate upper bound of frequency response of the ambient audio sounds.

Accordingly, for frequency ranges in which the frequency content of the source audio signal, the frequency content of the ambient audio sounds, and the frequency response of the transducer do not "intersect"—in other words, frequency ranges in which at least one of the source audio signal, the ambient audio sounds, and the transducer have content/response but at least one of the source audio signal, the ambient audio sounds, and the transducer do not have content/response—frequency bias selector 46 may cause bandpass filter 44 to bandpass filter white noise generated by noise source 42 within such a frequency range, thus generating an injected noise signal having content only within such frequency range. Thus, when W coefficient control block 31 compares reference microphone signal ref to the playback corrected error, to the extent there exists a frequency range in which the frequency content of reference microphone signal ref and the playback corrected error do not intersect, coefficient bias control block 40 injects white noise into the reference microphone signal ref or the playback corrected error (e.g., by combiners 35A and 37A, respectively) within such frequency range, so that the compared signals have content throughout the same intersecting frequency spectrum, and thus biasing adaptation coefficients in the frequency range towards zero. Similarly, when SE coefficient control block 33 compares a source audio signal to the playback corrected error, to the extent there exists a frequency range in which the frequency content of the source audio signal and the playback corrected error do not intersect, coefficient bias control block 40 injects white noise into the source audio signal or the playback corrected error (e.g., by combiners 35B and 37B, respectively) within such frequency range, so that the compared signals have content throughout the same intersecting frequency spectrum, and thus biasing adaptation coefficients in the frequency range towards zero. Without the injection of noise as described herein, W coefficient control block 31 and/or S coefficient control block 33 may, in a frequency range in which the frequency content of the comparison signals do not intersect, attempt to nonetheless adapt filter responses in such frequency range, which may lead to adaptation instability.

FIG. 3 and the foregoing description thereof contemplate injection of noise signal into both of W coefficient control block 31 and SE coefficient control block 33. However, in some embodiments, ANC circuit 30 may be configured such that coefficient bias control block 40 may inject noise into one of W coefficient control block 31 and SE coefficient control block 33, but not both. If noise injection is applied to W coefficient control block 31, as the W(z) response adapts, it may not matter that the SE(z) response is a good model of the secondary path in the frequency range in which noise is injected as the W(z) response adaptation coefficients will be biased towards zero in such frequency range. Similarly, if noise injection is applied to SE coefficient control block 33, the SE(z) response will not attempt to model the secondary path in the frequency range in which noise is injected, and because the SE(z) response in such frequency range will be small, it does no harm to the stability of the adaptation of the W(z) response in a least-mean-square adaptation system.

In some embodiments, coefficients of SE coefficient control block 33 may initialize with a bandlimited frequency response for the SE(z) response, thus allowing for a starting point for adaptation of the SE(z) response before any source audio signal for training the SE(z) response appears so that the SE(z) response does not attempt to model the true secondary path beyond any likely initial playback bandwidth. Thus, in case the source audio signal is narrowband (e.g., downlink speech in the telephone voice band), there will be no significant ambient content at higher frequencies being passed through filter 34B as input to W coefficient control block 31 that might lead to instability.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

All examples and conditional language recited herein are intended for pedagogical objects to aid the reader in understanding the invention and the concepts contributed by the inventor to furthering the art, and are construed as being without limitation to such specifically recited examples and conditions. Although embodiments of the present inventions have been described in detail, it should be understood that various changes, substitutions, and alterations could be made hereto without departing from the spirit and scope of the disclosure.

What is claimed is:

1. A personal audio device comprising:

a transducer for reproducing an audio signal including both a source audio signal for playback to a listener and an anti-noise signal for countering the effects of ambient audio sounds in an acoustic output of the transducer;

a reference microphone for providing a reference microphone signal indicative of the ambient audio sounds;

an error microphone located in proximity to the transducer for providing an error microphone signal indicative of the acoustic output of the transducer and the ambient audio sounds at the transducer; and a processing circuit that implements:

an adaptive filter having a response that generates the anti-noise signal from the reference microphone signal to reduce the presence of the ambient audio sounds heard by the listener;

a coefficient control block that shapes the response of the adaptive filter in conformity with the error microphone signal and the reference microphone signal by adapting the response of the adaptive filter to minimize the ambient audio sounds in the error microphone signal; and a coefficient bias control block which biases coefficients of the coefficient control block towards zero in a range of frequencies outside of a frequency response of the source audio signal.

2. The personal audio device of claim 1, wherein the range of frequencies is within a frequency response of the transducer and within a frequency response of the ambient audio sounds.

3. The personal audio device of claim 1, wherein the transducer is integral to a stereo audio headset.

4. The personal audio device of claim 1, wherein the coefficient bias control block dynamically tracks frequency content of the source audio signal in order to determine a lower bound of the range of frequencies based on an upper bound of frequency content of the source audio signal.

5. The personal audio device of claim 4, wherein the upper bound of the range of frequencies is an upper bound of frequency response of the transducer.

6. The personal audio device of claim 1, wherein the coefficient bias control block injects a noise signal within the range of frequencies into the coefficient control block to bias coefficients of the coefficient control block by causing the coefficient control block to shape the response of the adaptive filter in conformity with the error microphone signal combined with the noise signal and the reference microphone signal combined with the noise signal.

7. The personal audio device of claim 6, in which coefficients of the coefficient control block update in accordance with a least-mean-squares algorithm.

8. The personal audio device of claim 6, wherein the coefficient bias control block comprises:

a noise source for generating a white noise signal; and a bandpass filter for filtering the white noise signal within the range of frequencies to generate the noise signal.

9. A method for canceling ambient audio sounds in the proximity of a transducer of a personal audio device, the method comprising:

receiving a reference microphone signal indicative of the ambient audio sounds;

receiving an error microphone signal indicative of the output of the transducer and the ambient audio sounds at the transducer;

adaptively generating an anti-noise signal, from the reference microphone signal, countering the effects of ambient audio sounds at an acoustic output of the transducer by adapting a response of an adaptive filter that filters an output of the reference microphone to minimize the ambient audio sounds in the error microphone signal;

biasing coefficients for controlling the response of the adaptive filter towards zero in a range of frequencies outside of a frequency response of a source audio signal; and combining the anti-noise signal with the source audio signal to generate an audio signal provided to the transducer.

10. The method of claim 9, wherein the range of frequencies is within a frequency response of the transducer and within a frequency response of the ambient audio sounds.

11. The method of claim 9, wherein the transducer is integral to a stereo audio headset.

12. The method of claim 9, further comprising dynamically tracking frequency content of the source audio signal in order to determine a lower bound of the range of frequencies based on an upper bound of frequency content of the source audio signal.

13. The method of claim 12, wherein the upper bound of the range of frequencies is an upper bound of frequency response of the transducer.

14. The method of claim 9, further comprising injecting a noise signal within the frequency range in order to bias coefficients by shaping the response of the adaptive filter in conformity with the error microphone signal combined with the noise signal and the reference microphone signal combined with the noise signal.

15. The method of claim 14, in which coefficients update in accordance with a least-mean-squares algorithm.

16. The method of claim 14, further comprising:

generating a white noise signal; and bandpass filtering the white noise signal within the range of frequencies to generate the noise signal.

17. An integrated circuit for implementing at least a portion of a personal audio device, comprising:

an output for providing a signal to a transducer including both a source audio signal for playback to a listener and an anti-noise signal for countering the effect of ambient audio sounds in an acoustic output of the transducer;

a reference microphone input for receiving a reference microphone signal indicative of the ambient audio sounds;

an error microphone input for receiving an error microphone signal indicative of the output of the transducer and the ambient audio sounds at the transducer; and a processing circuit that implements:

an adaptive filter having a response that generates the anti-noise signal from the reference microphone signal to reduce the presence of the ambient audio sounds heard by the listener;

a coefficient control block that shapes the response of the adaptive filter in conformity with the error microphone signal and the reference microphone signal by adapting the response of the adaptive filter to minimize the ambient audio sounds in the error microphone signal; and a coefficient bias control block which biases coefficients of the coefficient control block towards zero in a range of frequencies outside of a frequency response of the source audio signal.

18. The integrated circuit of claim 17, wherein the range of frequencies is within a frequency response of the transducer and within a frequency response of the ambient audio sounds.

19. The integrated circuit of claim 17, wherein the transducer is integral to a stereo audio headset.

20. The integrated circuit of claim 17, wherein the coefficient bias control block dynamically tracks frequency content of the source audio signal in order to determine a lower bound of the range of frequencies based on an upper bound of frequency content of the source audio signal.

21. The integrated circuit of claim 20, wherein the upper bound of the range of frequencies is an upper bound of frequency content of the transducer.

22. The integrated circuit of claim 17, wherein the coefficient bias control block injects a noise signal within the range of frequencies into the coefficient control block to bias coefficients of the coefficient control block by causing the coefficient control block to shape the response of the adaptive filter in conformity with the error microphone signal combined with the noise signal and the reference microphone signal combined with the noise signal.

23. The integrated circuit of claim 22, in which coefficients of the coefficient control block update in accordance with a filtered-X least-mean-squares algorithm.

24. The integrated circuit of claim 22, wherein the coefficient bias control block comprises:

a noise source for generating a white noise signal; and a bandpass filter for filtering the white noise signal within the range of frequencies to generate the noise signal.

25. A personal audio device comprising:

a transducer for reproducing an audio signal including both a source audio signal for playback to a listener and an anti-noise signal for countering the effects of ambient audio sounds in an acoustic output of the transducer;

a reference microphone for providing a reference microphone signal indicative of the ambient audio sounds;

an error microphone located in proximity to the transducer for providing an error microphone signal indicative of the acoustic output of the transducer and the ambient audio sounds at the transducer; and a processing circuit that implements:

a feedforward filter having a response that generates the anti-noise signal from the reference microphone signal to reduce the presence of the ambient audio sounds heard by the listener;

a secondary path estimate adaptive filter configured to model an electro-acoustic path of the source audio signal and have a response that generates a secondary path estimate from the source audio;

a coefficient control block that shapes the response of the secondary path estimate adaptive filter in conformity with the source audio signal and a playback corrected error by adapting the response of the secondary path estimate filter to minimize the playback corrected error, wherein the playback corrected error is based on a difference between the error microphone signal and the secondary path estimate; and a coefficient bias control block which biases coefficients of the coefficient control block towards zero in a range of frequencies outside of a frequency response of the source audio signal.

26. The personal audio device of claim 25, wherein the range of frequencies is within a frequency response of the transducer and within a frequency response of the ambient audio sounds.

27. The personal audio device of claim 25, wherein the transducer is integral to a stereo audio headset.

28. The personal audio device of claim 25, wherein the coefficient bias control block causes a set of starting coefficients to be applied by a coefficient control block, such set of starting coefficients bandlimited to a maximum frequency corresponding to a likely frequency response of the source audio signal prior to the coefficient control block shaping the response of the secondary path estimate adaptive filter.

29. The personal audio device of claim 28, wherein the set of starting coefficients are determined based on a bandlimited training signal applied in place of the source audio signal.

30. A method for canceling ambient audio sounds in the proximity of a transducer of a personal audio device, the method comprising:

receiving a reference microphone signal indicative of the ambient audio sounds;

receiving an error microphone signal indicative of the output of the transducer and the ambient audio sounds at the transducer;

generating an anti-noise signal component, from the reference microphone signal, countering the effects of ambient audio sounds at an acoustic output of the transducer by filtering an output of the reference microphone;

adaptively generating a secondary path estimate, from a source audio signal, by filtering the source audio signal with a secondary path estimate adaptive filter configured to model an electro-acoustic path of the source audio signal and adapting the response of the secondary path estimate adaptive filter to minimize a playback corrected error, wherein the playback corrected error based on a difference between the error microphone signal and the secondary path estimate;

biasing coefficients for controlling the response of the secondary path estimate adaptive filter towards zero in a range of frequencies outside of a frequency response of the source audio signal; and combining the anti-noise signal with the source audio signal to generate an audio signal provided to the transducer.

31. The method of claim 30, wherein the range of frequencies is within a frequency response of the transducer and within a frequency response of the ambient audio sounds.

32. The method of claim 30, wherein the transducer is integral to a stereo audio headset.

33. The method of claim 30, further comprising applying a set of starting coefficients as the coefficients, such set of starting coefficients bandlimited to a maximum frequency corresponding to a likely frequency response of the source audio signal prior to shaping the response of the secondary path estimate adaptive filter.

34. The method of claim 33, wherein the set of starting coefficients are determined based on a bandlimited training signal applied in place of the source audio signal.

35. An integrated circuit for implementing at least a portion of a personal audio device, comprising:

an output for providing a signal to a transducer including both a source audio signal for playback to a listener and an anti-noise signal for countering the effect of ambient audio sounds in an acoustic output of the transducer;

a reference microphone input for receiving a reference microphone signal indicative of the ambient audio sounds;

an error microphone input for receiving an error microphone signal indicative of the output of the transducer and the ambient audio sounds at the transducer; and a processing circuit that implements:

a feedforward filter having a response that generates the anti-noise signal from the reference microphone signal to reduce the presence of the ambient audio sounds heard by the listener;

a secondary path estimate adaptive filter configured to model an electro-acoustic path of the source audio signal and have a response that generates a secondary path estimate from the source audio;

a coefficient control block that shapes the response of the secondary path estimate adaptive filter in conformity with the source audio signal and a playback corrected error by adapting the response of the secondary path estimate filter to minimize the playback corrected error, wherein the playback corrected error is based on a difference between the error microphone signal and the secondary path estimate; and a coefficient bias control block which biases coefficients of the coefficient control block towards zero in a range of frequencies outside of a frequency response of the source audio signal.

36. The integrated circuit of claim 35, wherein the range of frequencies is within a frequency response of the transducer and within a frequency response of the ambient audio sounds.

37. The integrated circuit of claim 35, wherein the transducer is integral to a stereo audio headset.

38. The integrated circuit of claim 35, wherein the coefficient bias control block causes a set of starting coefficients to be applied by a coefficient control block, such set of starting coefficients bandlimited to a maximum frequency corresponding to a likely frequency response of the source audio signal prior to the coefficient control block shaping the response of the secondary path estimate adaptive filter.

39. The integrated circuit of claim 38, wherein the set of starting coefficients are determined based on a bandlimited training signal applied in place of the source audio signal.

* * * * *